US010665916B2

(12) United States Patent
Torok

(10) Patent No.: US 10,665,916 B2
(45) Date of Patent: May 26, 2020

(54) POLARIZER ASSEMBLY

(71) Applicant: Parker-Hannifin Corporation, Cleveland, OH (US)

(72) Inventor: Peter Z. Torok, Brockport, NY (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 16/326,192

(22) PCT Filed: Sep. 6, 2017

(86) PCT No.: PCT/US2017/050176
§ 371 (c)(1),
(2) Date: Feb. 16, 2019

(87) PCT Pub. No.: WO2018/048834
PCT Pub. Date: Mar. 15, 2018

(65) Prior Publication Data

US 2019/0181522 A1 Jun. 13, 2019

Related U.S. Application Data

(60) Provisional application No. 62/383,778, filed on Sep. 6, 2016.

(51) Int. Cl.
*H01P 1/17* (2006.01)
*H01P 11/00* (2006.01)
*H01P 1/04* (2006.01)

(52) U.S. Cl.
CPC ..... *H01P 1/17* (2013.01); *H01P 1/042* (2013.01); *H01P 11/002* (2013.01)

(58) Field of Classification Search
CPC ..... H01P 1/17; H01P 1/042; H01P 11/002
(Continued)

(56) References Cited

U.S. PATENT DOCUMENTS 6,201,508 B1 3/2001 Metzen et al.
8,594,587 B2 11/2013 Jackson et al.
(Continued)

FOREIGN PATENT DOCUMENTS

CN 1599127 A 3/2005
CN 204230388 U 3/2015
JP 2008-025785 A 2/2008

OTHER PUBLICATIONS

International Search Report and Written Opinion for corresponding International Application No. PCT/US2017/050176 dated Dec. 4, 2017.

(Continued)

*Primary Examiner* — Robert J Pascal
*Assistant Examiner* — Kimberly E Glenn
(74) *Attorney, Agent, or Firm* — Renner, Otto, Boisselle & Sklar, LLP

(57) ABSTRACT

A polarizer assembly including first and second components having respective first and second channel portions. The first and second components are configured to flex between a pre-fastened state and a fastened state. In the pre-fastened state, a first flange face of a flange of the first component contacts an opposite facing second flange face of a flange of the second component at contact regions along respective edges of the first and second channel portions to form a nonuniform thickness gap between the first and second flange faces outwardly from the contact regions toward outer edges of the first and second components. In the fastened state, the first flange face is engaged flush with the second flange face to close the nonuniform thickness gap.

20 Claims, 12 Drawing Sheets

(58) Field of Classification Search
USPC ..... 333/21 A
See application file for complete search history.

(56) References Cited

U.S. PATENT DOCUMENTS

| | | | |
|---|---|---|---|
| 2008/0117005 | A1 | 5/2008 | Eom et al. |
| 2008/0303613 | A1 | 12/2008 | Lau et al. |
| 2010/0289602 | A1 | 11/2010 | Ligander et al. |
| 2011/0032057 | A1 | 2/2011 | Lin et al. |
| 2011/0156844 | A1 | 6/2011 | Wakabayashi et al. |
| 2014/0070904 | A1 | 3/2014 | Cahill et al. |
| 2014/0077903 | A1 | 3/2014 | Lienkewicz et al. |

OTHER PUBLICATIONS

International Preliminary Report on Patentability for corresponding International Application No. PCT/US2017/050176 dated Aug. 1, 2018.

Eom et al., "A New Comb Circular Polarizer Suitable for Millimeter-Band Application", ETRI Journal, vol. 28, No. 5, Oct. 2016, pp. 656-659.

POLARIZER ASSEMBLY

RELATED APPLICATIONS

This application is a national phase of International Application No. PCT/US2017/050176 filed Sep. 6, 2017 and published in the English language, and claims priority to U.S. Application No. 62/383,778 filed Sep. 6, 2016, which are incorporated herein by reference.

FIELD OF INVENTION

This application relates generally to satellite communications antenna systems and devices, and more particularly to polarizer assemblies for such systems and devices.

BACKGROUND

Conventional ground based satellite communication antenna systems may include for example an antenna feed horn connected to a transceiver. More specifically, transmit and receive ports of the transceiver are connected to an orthomode transducer (OMT) waveguide device, which includes one or more waveguides. The waveguides of the OMT waveguide device, in turn, are connected to one end of a polarizer assembly. An opposite end of the polarizer assembly is connected to the feed horn antenna.

The typical polarizer assembly may include a pair of one part geometry components or be made up of parts having different geometries. The components include flanges that enable both opposite sides of the components to be assembled in a "clamshell" enclosure fashion. Whether the geometric configuration is single or multi part, a gap free continuous seal bead between the first and second components is required for proper signal processing performance by the channel.

For some polarizer assemblies, there remain various shortcomings, drawbacks, and disadvantages relative to certain applications. For example, some polarizer assemblies have used a rectangular bead raised relative to the flanges of the components at the seam line edge of the functional channel. When the component flanges are fastened together, the rectangular beads create a tight seal. The seal however has been found to provide less than optimal signal processing, particularly when compared to a polarizer assembly being made of single piece construction. Accordingly, there remains a need for further contributions in this area of technology.

SUMMARY OF INVENTION

The present invention is directed to a polarizer assembly in which the flange face of one component contacts the flange face of an opposing component to form a nonuniform thickness gap therebetween in a pre-fastened state. The components are configured to flex between the pre-fastened state and a fastened state as they are being fastened such that in the fastened state the flange faces are flush against each other to form a tight seal bead at the edges of channel portions of the components.

The inventor found that during assembly of the polarizer assembly described in the background in which there is provided a rectangular bead raised relative to the flanges of the components at the seam line edge of the functional channel assembly, the tightening together of the rectangular beads tends to create gaps or distortions in the seal bead. When the polarizer components are initially brought together, the raised rectangular beads abut one another with a gap the height of the bead residing between the component flanges just outside the outer edge of the beads. The inventor found that as the flanges are fastened or clamped together to close the gap, the rectangular beads are compressed together so as to bend the rectangular beads. The compressing together of the rectangular beads is intended to create a seal therebetween. The inventor found, however, that the closure of the gap between the flanges tends to create a hinging effect at the outer edge (flange side edge) of the seal bead and, as such, as the primary gap between the flanges is closed, a secondary gap occurs at the inner edge (channel side edge) of the seal bead. The inventor found that this secondary gap was detrimental to seam line integrity and proper signal processing of the polarizer assembly.

According to one aspect of the invention, a polarizer assembly includes a first component including a first channel portion and first flanges having first flange faces on opposite sides of the first channel portion; and a second component including a second channel portion and second flanges having second flange faces on opposite sides of the second channel portion. The first and second channel portions may form a channel that functions to polarize waveforms when the first and second components are in a fastened state. The first and second components may be configured to flex between a pre-fastened state and the fastened state, wherein in the pre-fastened state the first flange face of at least one of the first flanges contacts an opposite facing second flange face of at least one of the second flanges at contact regions along respective edges of the first and second channel portions to form a nonuniform thickness gap between the first and second flange faces outwardly from the contact regions toward outer edges of the first and second components, and wherein in the fastened state the first flange face is engaged flush with the second flange face to close the nonuniform thickness gap.

Embodiments of the invention may include one or more of the following additional features separately or in combination.

The polarizer assembly may be configured such that in an intermediate fastened state an outer edge of the first flange face contacts the second flange face such that the nonuniform thickness gap is formed between the channel edge contact regions and the outer edge contact of the first flange face with the second flange face.

The at least one of the first flange faces may have a first ramp that slopes away from the second flange face as the first ramp extends outwardly from the edge of the first channel portion toward the outer edge of the first component such that in the pre-fastened state an inner edge of the first flange face contacts the second flange face to form a sloped gap between the first and second flange faces outwardly from the inner edge of the first flange face, and in the fastened state the first ramp is engaged flush with the second flange face outwardly from the inner edge of the first flange face.

In the pre-fastened state, the angle of the slope of the first ramp may be between about 0.5 degrees and about 3.0 degrees from a horizontal plane that is perpendicular to an inside wall at the edge of the first channel portion.

In the pre-fastened state, the angle of the slope of the first ramp may be about 1 degree from the horizontal plane that is perpendicular to an inside wall at the edge of the first channel portion.

The second flange face may have a second ramp that slopes away from the first flange face as the second ramp extends outwardly from the edge of the second channel portion toward the outer edge of the second component such that in the pre-fastened state the sloping away of the second ramp contributes to the formation of the nonuniform thickness gap between the first and second flange faces.

In the pre-fastened state, the angle of the slope of the first ramp may be substantially equal to the angle of the slope of the second ramp.

The first flange may include fasteners disposed along a fastener centerline spaced outwardly from the edge of the first channel portion and in the pre-fastened state the first ramp may extend outwardly from the edge of the first channel portion to the fastener centerline.

The first flange may include fasteners disposed along a fastener centerline spaced outwardly from the edge of the first channel portion and in the pre-fastened state the first ramp may extend outwardly from the edge of the first channel portion to a position between the edge of the first channel portion and the fastener centerline.

In the pre-fastened state, the first ramp may extend outwardly from the edge of the first channel portion to a planar portion that lies in a horizontal plane that is perpendicular to an inside wall at the edge of the first channel portion.

In the pre-fastened state, the first ramp may extend outwardly from the edge of the first channel portion to an outer ramp that slopes toward the second flange face as the outer ramp extends outwardly from an outer edge of the first ramp toward the outer edge of the first component.

In the pre-fastened state, the outer edge of the first flange face may contact the second flange face such that the nonuniform thickness gap is formed between the inner and outer edge contacts of the first flange face with the second flange face.

In the pre-fastened state, the angle of the slope of the outer ramp may be between about 0.5 degrees and about 3.0 degrees from a horizontal plane that is perpendicular to an inside wall at the edge of the first channel portion.

The first and second components may have the same geometry.

According to another aspect of the invention, a polarizer assembly may include first component including a first channel portion and first flanges on opposite sides of the first channel portion; and a second component including a second channel portion and second flanges on opposite sides of the second channel portion. The first and second channel portions may form a channel that functions to polarize waveforms when the first and second components are in a fastened state. The first and second flanges may have respective first and second flange faces that face each other. At least one of the first flange faces may have a first ramp that slopes away from the second flange face over at least a portion of the distance between an edge of the first channel portion and an outer edge of the first component such that in a pre-fastened state an initial contact edge of the first flange face contacts the second flange face to form a nonuniform gap between the first and second flange faces outwardly from the initial contact edge. The first and second components may be configured to flex between the pre-fastened state and the fastened state such that in the fastened state the ramp of the first flange face engages flush with the second flange face outwardly from the initial contact edge of the first flange face.

Embodiments of the invention may include one or more of the following additional features separately or in combination.

The first ramp may slope away from the second flange face outwardly from the edge of the first channel portion toward an outer edge of the first component.

The initial contact edge may be an inside edge of the first flange face.

In the pre-fastened state, the initial contact edge of the first flange face may contact the second flange face at the edge of the first channel portion, and in the fastened state the ramp of the first flange face may engage flush with the second flange face outwardly from the edge of the first channel portion.

In the pre-fastened state, the angle of the slope of the first ramp may be between about 0.5 degrees and about 3.0 degrees from a horizontal plane that is perpendicular to an inside wall at the edge of the first channel portion.

In the pre-fastened state, the angle of the slope of the first ramp may be about 1 degree from the horizontal plane that is perpendicular to an inside wall at the edge of the first channel portion.

The following description and the annexed drawings set forth certain illustrative embodiments of the invention. These embodiments are indicative, however, of but a few of the various ways in which the principles of the invention may be employed. Other objects, advantages and novel features according to aspects of the invention will become apparent from the following detailed description when considered in conjunction with the drawings.

BRIEF DESCRIPTION OF THE DRAWINGS

The annexed drawings, which are not necessarily to scale, show various aspects of the invention.

DETAILED DESCRIPTION

Figure 1:
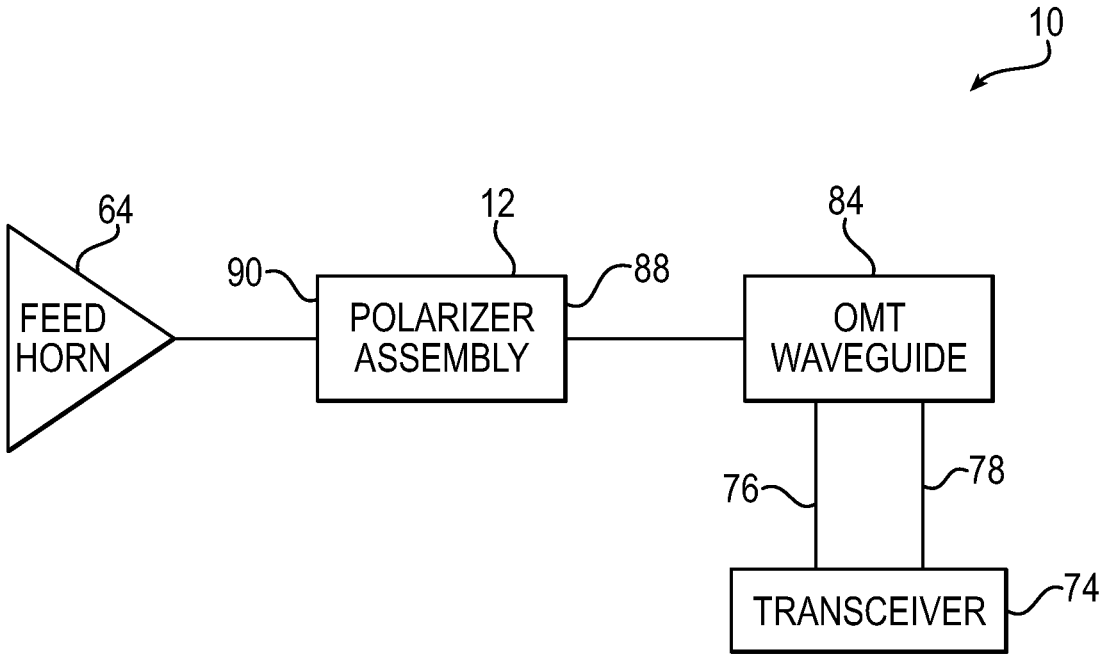
FIG. 1 is a block diagram of a satellite communications antenna system in accordance with the invention.

While the present invention can take many different forms, for the purpose of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications of the described embodiments, and any further applications of the principles of the invention as described herein, are contemplated as would normally occur to one skilled in the art to which the invention relates.

Figure 2:
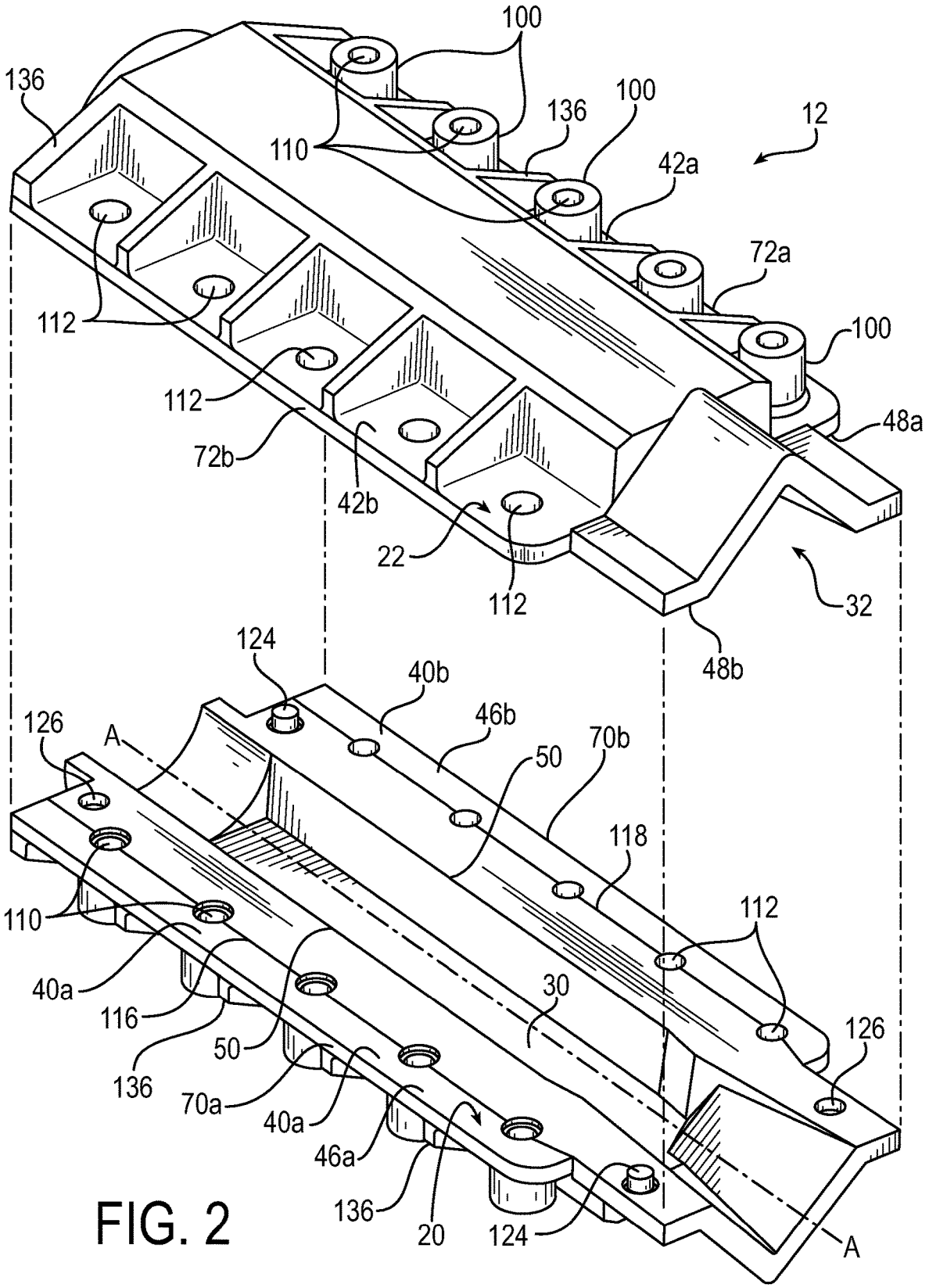
FIG. 2 is an exploded perspective view of a polarizer assembly of the FIG. 1 antenna system in accordance with the invention, showing the polarizer in a pre-assembled state.
Figure 3A:
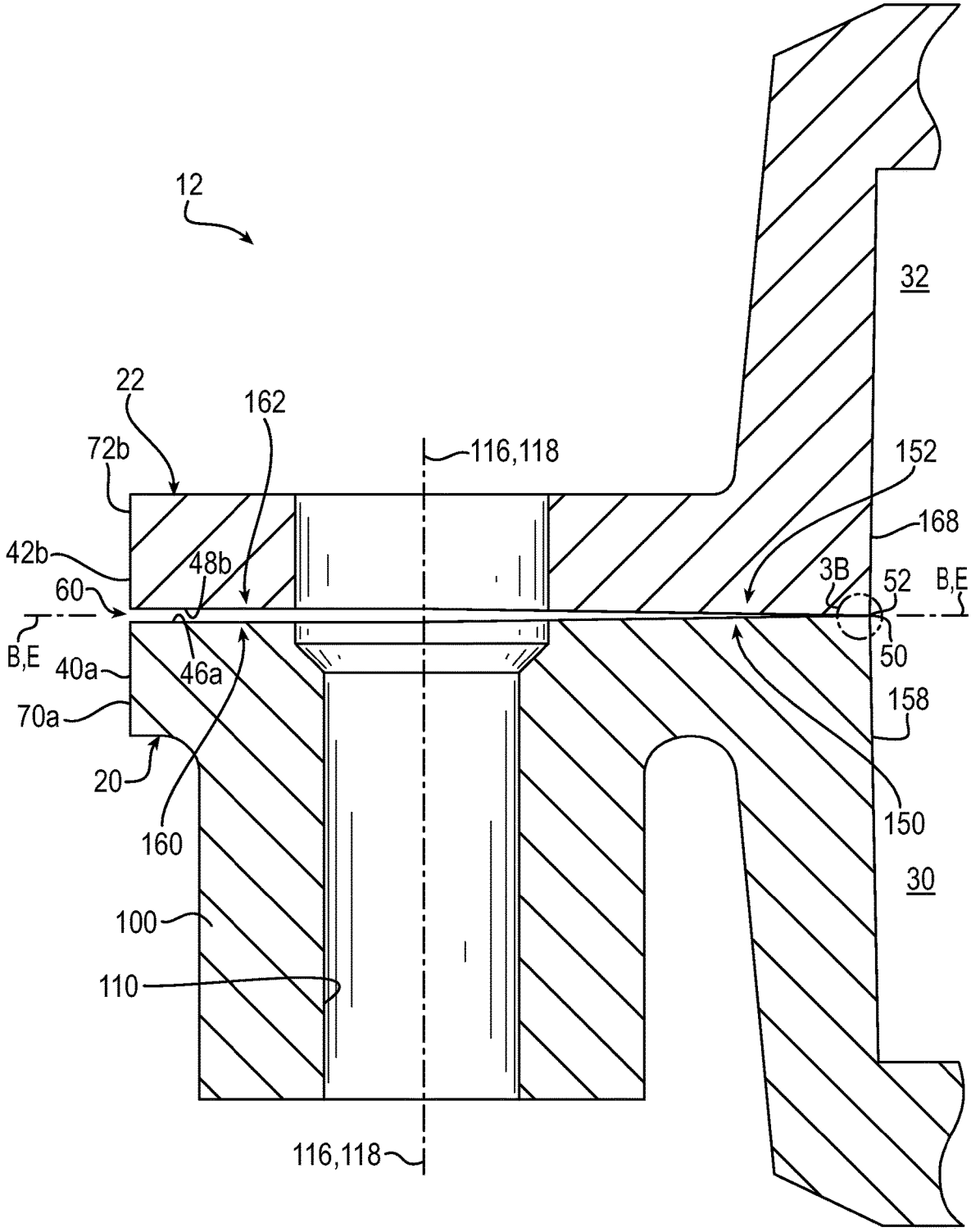
FIG. 3A is a cross section view of the polarizer assembly, showing first and second components in a pre-fastened state without a fastening member.
Figure 3B:
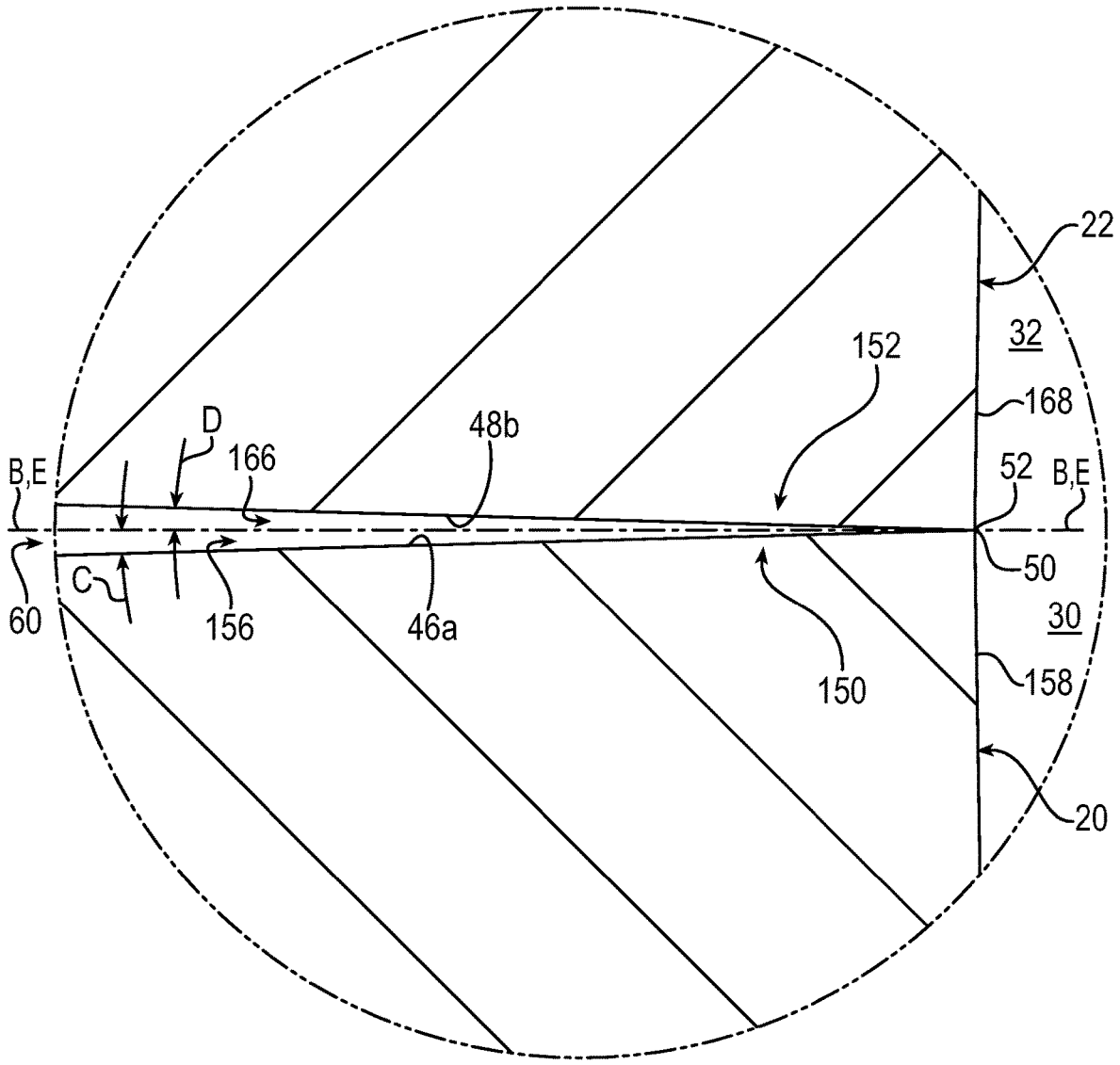
FIG. 3B is an enlarged view of a portion of FIG. 3A.
Figure 4:
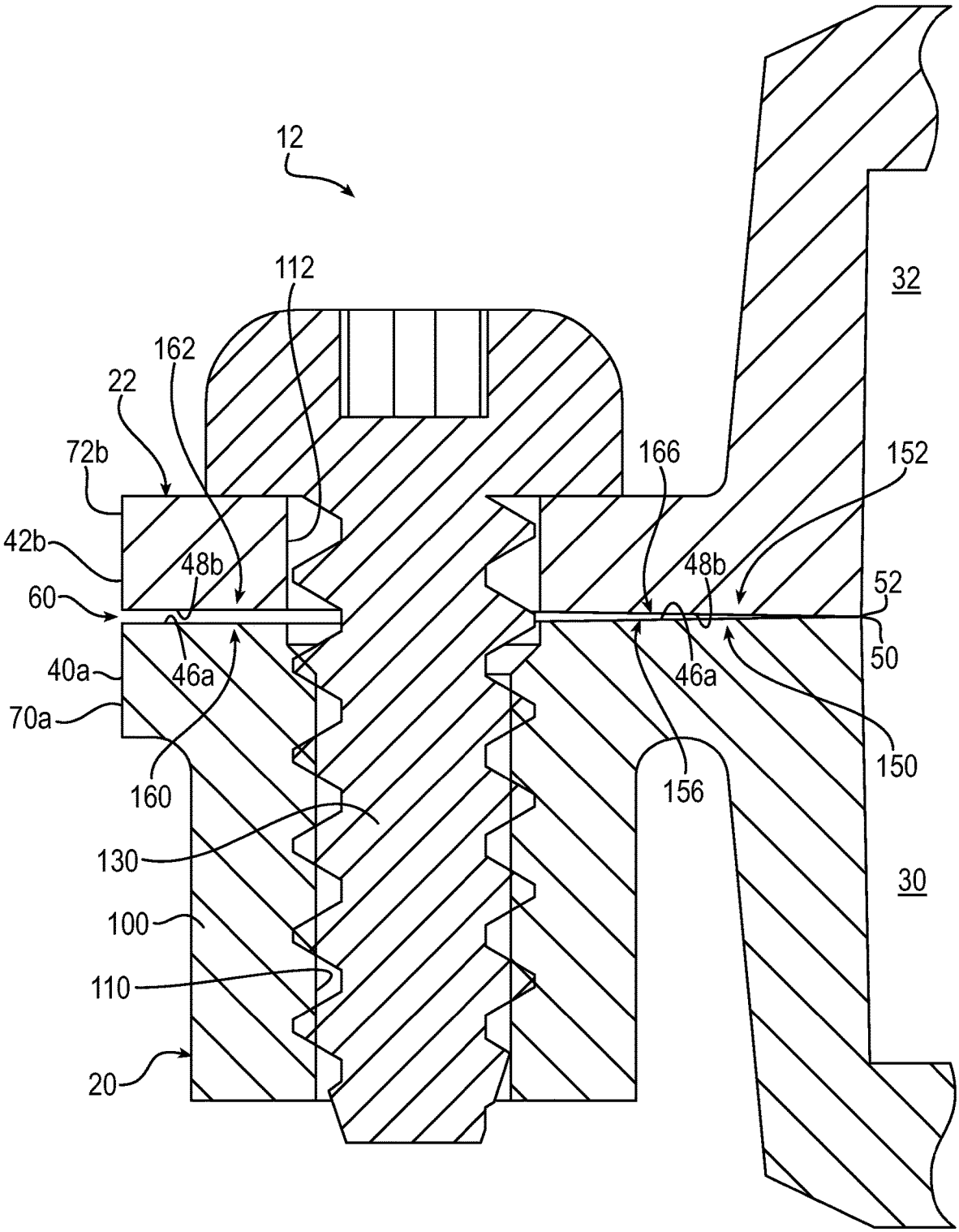
FIG. 4 is a cross-section view of the polarizer assembly, showing the first and second components in a pre-fastened state with a fastening member.
Figure 5:
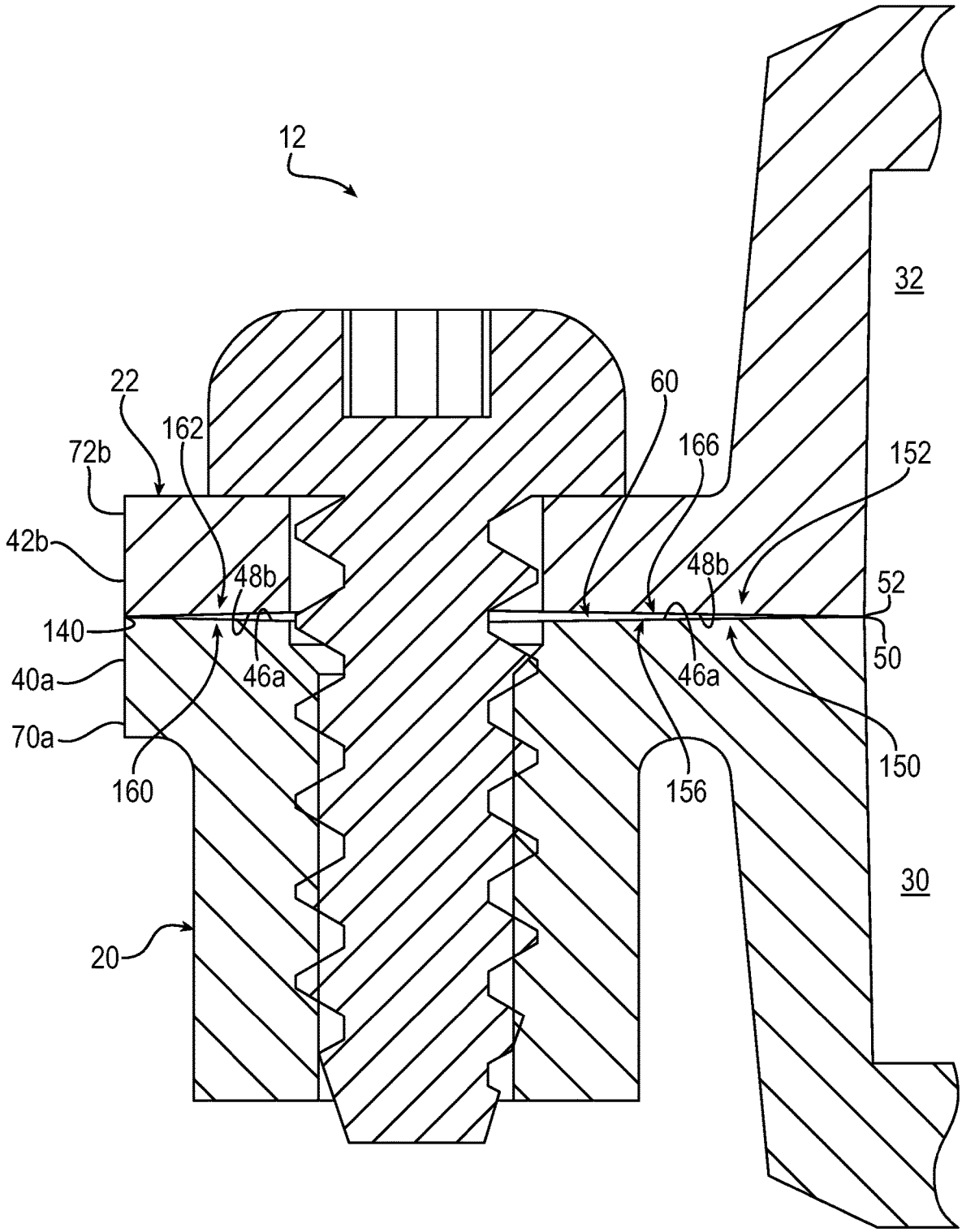
FIG. 5 is a cross-section view of the polarizer assembly, showing the first and second components in an intermediate fastened state with the fastening member.
Figure 6:
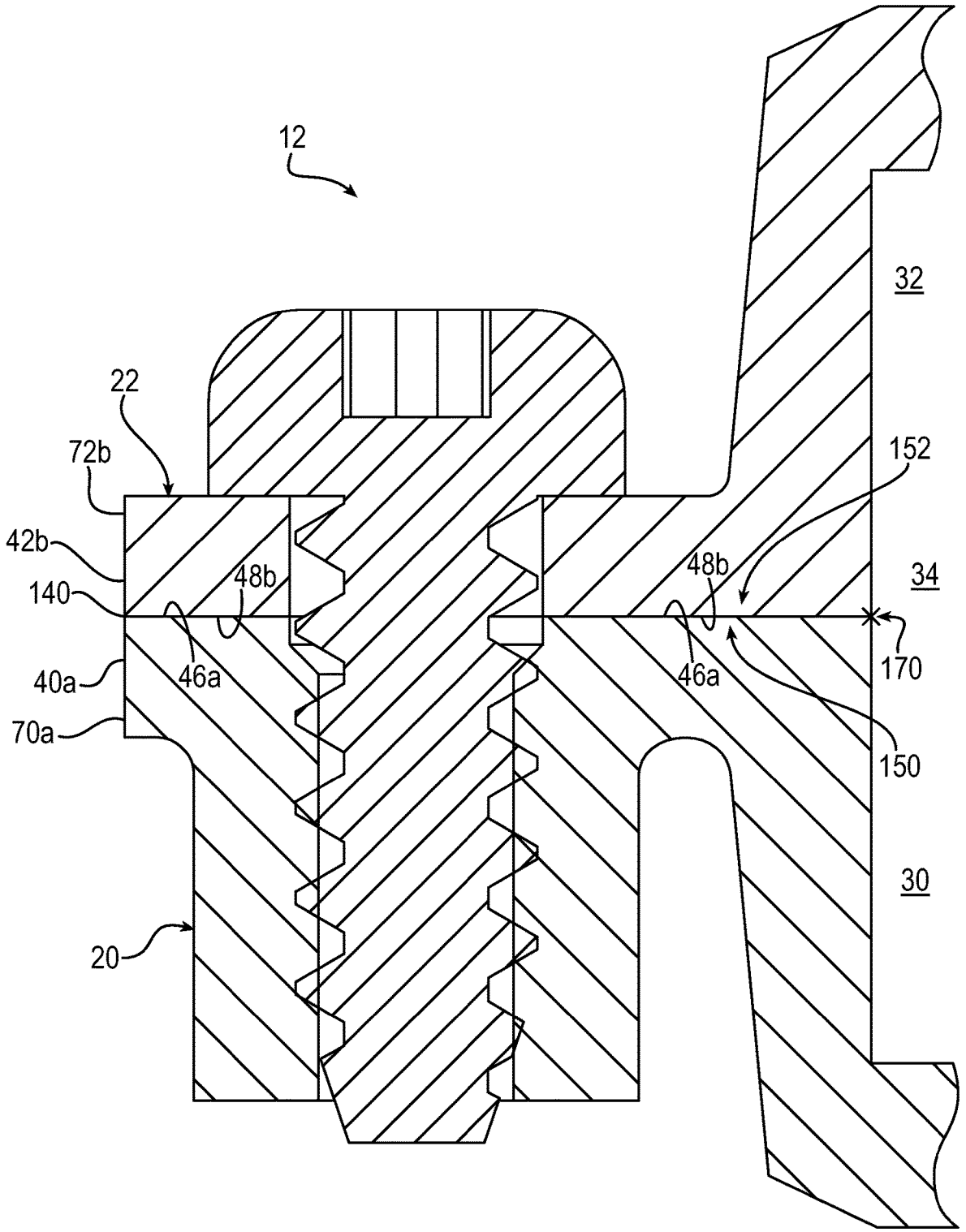
FIG. 6 is a cross-section view of the polarizer assembly in a fastened state with the fastening member.

FIGS. 1-6 show a satellite communications antenna system 10 and a polarizer assembly 12 thereof in accordance with the invention. The satellite communications antenna system 10 is merely an example application of the polarizer assembly 12, and the polarizer assembly 12 can be used in any electronics application for which microwave radio frequency (RF) signal shaping and filtering is desired. As shown in FIG. 2, the polarizer assembly 12 includes first and second "clamshell" components 20, 22 each of which includes a channel portion 30, 32 and flanges 40*a*, 40*b*, 42*a*, 42*b* on opposite sides of the channel portions 30, 32. As shown in FIG. 6, in a fastened state the channel portions 30, 32 together form a channel 34. The channel 34 functions to polarize waveforms, for example, from a waveguide to a feedhorn 64 of the satellite communications antenna system 10. The flanges 40*a*, 40*b* have respective flange faces 46*a*, 46*b*, and the flanges 42*a*, 42*b* have respective flange faces 48*a*, 48*b*. As will be described in greater detail below, the first and second components 20, 22 are configured to flex between a pre-fastened state as shown in FIG. 4 and a fastened state as shown in FIG. 6 without any gaps in the seam line of the channel 34. In the pre-fastened state, the flange face 46*a*, 46*b* of at least one of the first flanges 40*a*, 40*b* of the first component 20 contacts an opposite facing flange face 48*b*, 48*a* of at least one of the second flanges 42*b*, 42*a* of the second component 22 at contact regions 50, 52 (FIGS. 3A, 3B) along respective edges of the first and second channel portions 30, 32 to form a nonuniform thickness gap 60 between the flange faces 46*a* and 48*b* (and/or 46*b*, 48*a*) outwardly from the contact regions 50, 52 toward outer edges 70*a*, 70*b*, 72*a*, 72*b* of the first and second components 20, 22. In the fastened state (FIG. 6), the flange face 46*a* is engaged flush with the opposing flange face 48*b* to close the nonuniform thickness gap 60. As the flanges 40*a*, 42*b* are fastened together from the pre-fastened to the fastened state, the flush contact between the flange faces 46*a*, 48*b* maintains a tight seal bead at the edges of the first and second channel portions 30, 32. Once in the fastened state, the compressed flanges 40*a*, 42*b* maintain seam line integrity.

Referring to FIG. 1, the satellite communications antenna system 10 includes an antenna feed horn 64 connected to a transceiver 74. Transmit and receive ports 76, 78 of the transceiver 74 are connected to an orthomode transducer (OMT) waveguide device 84. The OMT waveguide device 84 may include one or more waveguides. The waveguides of the OMT waveguide device 84, in turn, are connected to one end 88 of the polarizer assembly 12. An opposite end 90 of the polarizer assembly 12 is connected to the feed horn antenna 64. The polarizer assembly 12 is configured to align the input of many divergent wave orientations within target frequencies into polarized horizontal and/or vertical waveforms. Thus, for example, the channel 34, or central passageway, of the polarizer assembly 12 may be configured to convert linearly polarized signals to circular polarized signals and/or vice versa. Of course, other configurations and types of polarizer assemblies are also contemplated. Moreover, it will be apparent to those skilled in the art that the present invention relates to a bead seal for any two piece or other multi-piece radio frequency (RF) filtering device and, while herein the RF filtering device is described in terms of a polarizer assembly 12, it will be understood that the polarizer assembly 12 is only one application of the invention and is in no way limiting to the invention. The invention can be used for any multi-piece or foldable construction of a polarizer, waveguide, or any other radio frequency filtering assembly, including clamshell and non-clamshell configurations.

The polarizer assembly 12 may be constructed of metal, such as zinc die cast material, or metal coated thermoplastic injection molded material. In one embodiment, the components 20, 22 are made of a PC-ABS thermoplastic (polycarbonate/acrylonitrile butadiene styrene), cleaned, and then etched with a copper layer, for example, a layer of about 4 microns. The metal layer can be etched on the entire thermoplastic surface of the components 20, 22 or merely on the functional surfaces such as the inside surfaces of the channel portions 30, 32 and at the seal bead and flange faces 46*a*, 46*b*, 48*a*, 48*b*. Of course, other types of materials and manufacturing methods are also contemplated.

Referring now to FIGS. 2, 3A and 3B, the illustrative polarizer assembly 12 is made up of a pair of one part geometry components; that is, the first and second components 20, 22 have identical geometries. The left flange 40*a* and right flange 40*b* of the first component 20 are configured to mate with the respective right flange 42*b* and left flange 42*a* of the second component 22 when the second component 22 is flipped as in a "clamshell" manner 180 degrees about the channel axis A-A relative to the first component 20 and clamped to the first component 20. As shown in FIG. 2, the left flanges 40*a*, 42*a* each have a plurality of bosses 100 and pilot holes 110 disposed along a fastener centerline 116. The right flanges 40*b*, 42*b* each have a plurality of through holes 112 disposed along a fastener centerline 118. The axial and transverse spacing between the through holes 112 of the right flanges 40*b*, 42*b* and the pilot holes 110 of the left flanges 40*a*, 42*a* is such that the holes 110, 112 axially and transversely align with one another when the second component 22 is flipped onto the first component 20, for example, into a pre-fastened state. The components 20, 22 may be equipped with locating pins 124 and mating slip fit pilot holes 126 at their opposite axial ends as shown in FIG. 2 to aid in properly axially and transversely aligning the components 20, 22 including their respective fastener holes 110, 112. As shown in FIGS. 3A and 3B, to fasten the right flange 40*b*, 42*b* of each component 20, 22 to the corresponding left flange 42*a*, 40*a* of the opposite facing component 22, 20, thread forming screws 130 are inserted through the through holes 112 and then screwed into the pilot holes 110, displacing the material around the pilot holes 110 so that the material flows around the threads of the screws 130 to create a zero fit clearance. The flanges 40*a*, 40*b*, 42*a*, 42*b* may be provided with axially spaced gussets or ribs 136 (FIG. 2) between the fastener locations 110, 112 to strengthen the components 20, 22 and prevent over flexing of the flanges 40*a*, 40*b*, 42*a*, 42*b* or buckling of the flanges 40*a*, 40*b*, 42*a*, 42*b* on opposite sides of the fastener centerlines 116, 118 during fastening.

As will be appreciated by those skilled in the art, the first and second components 20, 22 need not be limited to one part geometries and the means for fastening and/or clamping the first and second components 20, 22 need not be limited to thread forming screws 130. The first and second components 20, 22 may have different geometries. For example, the left and right flanges of the first component 20 may be fitted with bosses and pilot holes while the left and right flanges of the second component 22 are configured with through holes. In another form, fastening may be by means of machine bolts passed through through holes in the flanges 40*a*, 40*b*, 42*a*, 42*b* and secured by nuts to form bolted joints along the flanges 40*a*, 40*b*, 42*a*, 42*b*. In yet another form, heat staking may be used, whereby for example plastic or metal posts on the first flange are inserted into corresponding boss holes in the opposing flange, followed by swaging the material at the top of the posts to form a "rivet" head that clamps down on the bosses to secure the first and second components 20, 22 together. One or more external clamps, for example binder clips, can also or alternately be used to secure the flanges together. The first and second components 20, 22 may also or alternatively be clamped together by means of projections in one component locking and mating with openings in the opposite component, where the projections may be in the form of one or more of tabs, plugs, posts, nubs, protrusions, among others, and the openings may take the form of any one or more of holes, slots, cavities, recesses, among others. The first component may include thread forming screws that engage "unthreaded bosses" in the opposing second component. The first component may include standard screws passed through openings in the first component, with nuts on the opposite half of the screw head half at the second component. Standard rivets that are "headed" may also or alternatively be used to retain clamped closure of the first and second components when they are assembled. Snap fit tabs may also or alternatively be used, whereby for example tabs in the first component flex during assembly of the first component to the second component and, once in an assembled position, snap back into an opening in the second component to lock the first and second components in the assembled position. In one form, the snap fit tabs may be "snap barbs" in the first component and "snap barb receptacles" in the opposite facing second component. The fastening and/or clamping could also incorporate any combination of the foregoing methods, such as by clamping at the axially opposite ends of the flanges, and thread forming screws at the axially central portion of the flanges. Of course, other configurations and fastening methods may also or alternately be employed, as will be appreciated.

Reference is now made to FIGS. 3A-6, which show greater detail of the left and right flanges 40*a*, 42*b* of the first and second components 20, 22 and the deflections they undergo as they are fastened together from the pre-fastened state to the fastened state. As noted above, in the pre-fastened state, the first flange face 46*a* of the first flange 40*a* of the first component 20 contacts the opposite facing second flange face 48*b* of the second flange 42*b* of the second component 22 at contact regions 50, 52 along respective edges of the first and second channel portions 30, 32. As shown in FIGS. 3A, 3B and 4, the nonuniform thickness gap 60 formed between the flange faces 46*a*, 48*b* extends outwardly from the contact regions 50, 52 toward the outer edges 70*a*, 72*b* of the first and second components 20, 22. The nonuniform thickness gap 60 gradually increases in height as it extends away from the contact regions 50, 52. As the second flange 42*b* is fastened to the first flange 40*a*, in the intermediate fastened state shown in FIG. 5, an outer edge 140 of the first flange face 46*a* contacts the second flange face 48*b* such that the nonuniform thickness gap 60 is slightly narrowed relative to the pre-fastened state and extends between the channel edge contact regions 50, 52 and the outer edge contact 140 of the first flange face 46*a* with the second flange face 48*b*. In the fastened state shown in FIG. 6, the nonuniform thickness gap 60 is closed and the channel 34 is sealed.

The flanges 40*a* and 42*b* of the first and second components 20 and 22 of the polarizer assembly 12 can take on a wide variety of configurations in forming the nonuniform thickness gap 60 therebetween in the pre-fastened state and intermediate fastened state. FIGS. 3A, 3B and 4 show one such embodiment. Referring to FIGS. 3A and 3B, the first flange face 46*a* has a first ramp 150 that slopes away from the second flange face 48*b* as the first ramp 150 extends outwardly from the edge of the first channel portion 30 toward the outer edge 70*a* of the first component 20. In the illustrative embodiment, the angle C of the slope of the first ramp 150 is about 1 degree from a horizontal plane B-B that is perpendicular to an inside wall 158 at the edge of the first channel portion 30. As shown in the pre-fastened state of FIGS. 3A, 3B and 4, the inner edge of the first flange face 46*a* contacts the second flange face 48*b* to form a sloped gap 156 between the first and second flange faces 46*a*, 48*b* outwardly from the inner edge of the first flange face 46*a*. Similarly, referring again to FIGS. 3A and 3B, the second flange face 48*b* has a second ramp 152 that slopes away from the first flange face 46*a* as the second ramp 152 extends outwardly from the edge of the second channel portion 32 toward the outer edge 72 of the second component 22. In the illustrative embodiment, the angle D of the slope of the second ramp 152 is about 1 degree from a horizontal plane E-E that is perpendicular to an inside wall 168 at the edge of the second channel portion 32. As shown in the pre-fastened state of FIGS. 3A, 3B and 4, the inner edge of the second flange face 48*b* contacts the first flange face 46*a* to form a sloped gap 166 between the first and second flange faces 46*a*, 48*b* outwardly from the inner edge of the second flange face 48*b*. Thus, in the pre-fastened state the sloping away of both the first and second ramps 150, 152 contributes to the formation of the nonuniform thickness gap 60 between the first and second flange faces 46*a*, 48*b*.

In the embodiment of FIGS. 3A, 3B and 4, the first ramp 150 extends outwardly from the edge of the first channel portion 30 to the fastener centerline 116 of the first flange 40*a*. Further, the first ramp 150 extends to a planar portion 160 of the nonuniform thickness gap 60. The planar portion 160 is parallel to the horizontal plane B-B that is perpendicular to the inside wall 158 at the edge of the first channel portion 30. The second flange 42*b* is configured in a manner similar to the first flange 40*a* in the embodiment of FIGS. 3A, 3B. Thus, the second ramp 152 extends outwardly from the edge of the second channel portion 32 to the fastener centerline 118 of the second flange 42*b*. In addition, the second ramp 152 extends to a planar portion 162 of the nonuniform thickness gap 60. The planar portion 162 is parallel to the horizontal plane E-E that is perpendicular to the inside wall 168 at the edge of the second channel portion 32. The nonuniform thickness gap 60 of the polarizer assembly 12 thus has a wedge shape gap formed by the sloped gaps 156, 166 of the first and second ramps 150, 152, and a straight gap formed by the planar portions 160, 162, with the outer portion of the wedge shape gap having the same thickness, or height, as the inner portion of the straight gap, and the wedge shape gap thus transitioning into the straight gap.

In the fastened state shown in FIG. 6, the first ramp 150 and second ramp 152 are engaged flush with the respective second flange face 48*b* and first flange face 46*a* outwardly from the respective inner edges of the first flange face 46*a* and second flange face 48*b* to close the nonuniform thickness gap 60. As a result, the inner edges of the respective flange faces 46*a*, 48*b* join to form a seam line 170 (going into the page in FIG. 6) at the joint between first and second channel portions 30, 32.

In the polarizer assembly 12 of FIGS. 3A-6, the angle C of the slope of the first ramp 150 is substantially equal to the angle D of the slope of the second ramp 152, which in the present embodiment is 1 degree. It will be appreciated that the angles C and D may differ in other embodiments. For example, the angle C may be less than the angle D where less flexure and/or flexing force is necessary or desired in the first component 20 relative to the second component 22.

FIGS. 7-11 show respective polarizer assemblies 212, 312, 412, 512, 612 according to another embodiment of the invention. The polarizer assemblies 212, 312, 412, 512, 612 in FIGS. 7-11 are in many respects similar as the above-referenced FIG. 3A polarizer assembly 12, and consequently the same reference numerals are used to denote structures corresponding to similar structures in the FIG. 3A polarizer assembly 12. In addition, the foregoing description of the FIG. 3A polarizer assembly 12 is equally applicable to the polarizer assemblies 212, 312, 412, 512, 612 of FIGS. 7-11 except as noted below. Moreover, it will be appreciated upon reading and understanding the specification that aspects of the polarizer assemblies 12, 212, 312, 412, 512, 612 may be substituted for one another or used in conjunction with one another where applicable.

Figure 7:
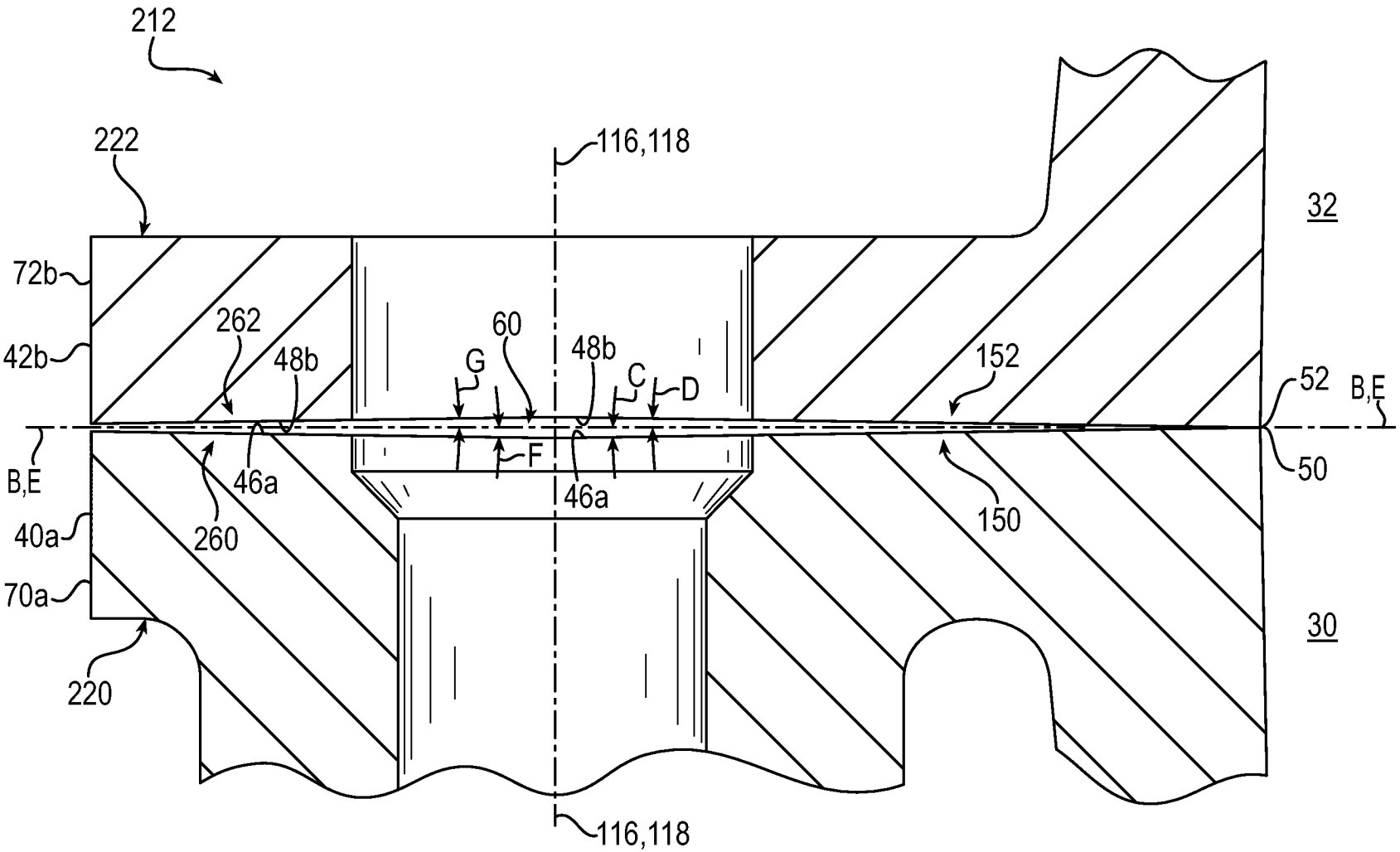
FIG. 7 is a cross-section view of a polarizer assembly in accordance with another embodiment of the invention.

In the polarizer assembly 212 of FIG. 7, the first and second components 220, 222 include respective first and second outer ramps 260, 262. In the pre-fastened state, which is shown in FIG. 7, the first ramp 150 extends outwardly from the edge of the first channel portion 30 to the outer ramp 260, which, in turn, slopes toward the second flange face 48*b* as the outer ramp 260 extends outwardly from an outer edge of the first ramp 150 toward the outer edge 70*a* of the first component 220. Similarly, the second ramp 152 extends outwardly from the edge of the second channel portion 32 to the outer ramp 262, which, in turn, slopes toward the first flange face 46*a* as the outer ramp 262 extends outwardly from an outer edge of the second ramp 160 toward the outer edge 72 of the second component 222. In this embodiment, the outer edge of the first and second inner ramps 150, 152 is the fastener centerline 116, 118. The angle F of the slope of the first outer ramp 260 is about 1 degree from the horizontal plane B-B that is perpendicular to the inside wall 158 at the edge of the first channel portion 30, and the angle G of the slope of the second outer ramp 262 is about 1 degree from the horizontal plane E-E that is perpendicular to the inside wall 168 at the edge of the second channel portion 32. The nonuniform thickness gap 60 of the polarizer assembly 12 thus has an inner wedge shape gap formed by the sloped gaps of the first and second inner ramps 150, 152, and an outer wedge shape gap formed by the sloped gaps of the first and second outer ramps 260, 262, with the wider portions of the inner and outer wedge shape gaps having the same thickness, or height, such that the inner wedge shape gap transitions into the outer wedge shape gap. It will be appreciated that in certain applications, only a single outer ramp, for example the first outer ramp 260, may be desired or necessary, such that the second outer ramp 262 can be omitted. As with the FIG. 3A polarizer assembly 12, when the FIG. 7 polarizer assembly 212 is in an intermediate fastened state, the outer edge of the first flange face 46*a* contacts the second flange face 48*b* such that the nonuniform thickness gap 60 is formed between the channel edge contact regions 50, 52 and the outer edge contact of the first flange face 46*a* with the second flange face 48*b*. Similarly, when the FIG. 7 polarizer assembly 212 is in the fastened state, the first flange face 46*a* is engaged flush with the second flange face 48*b* to close the nonuniform thickness gap 60, in a manner similar to that shown in FIG. 6 of the FIG. 3A polarizer assembly 12.

Figure 8:
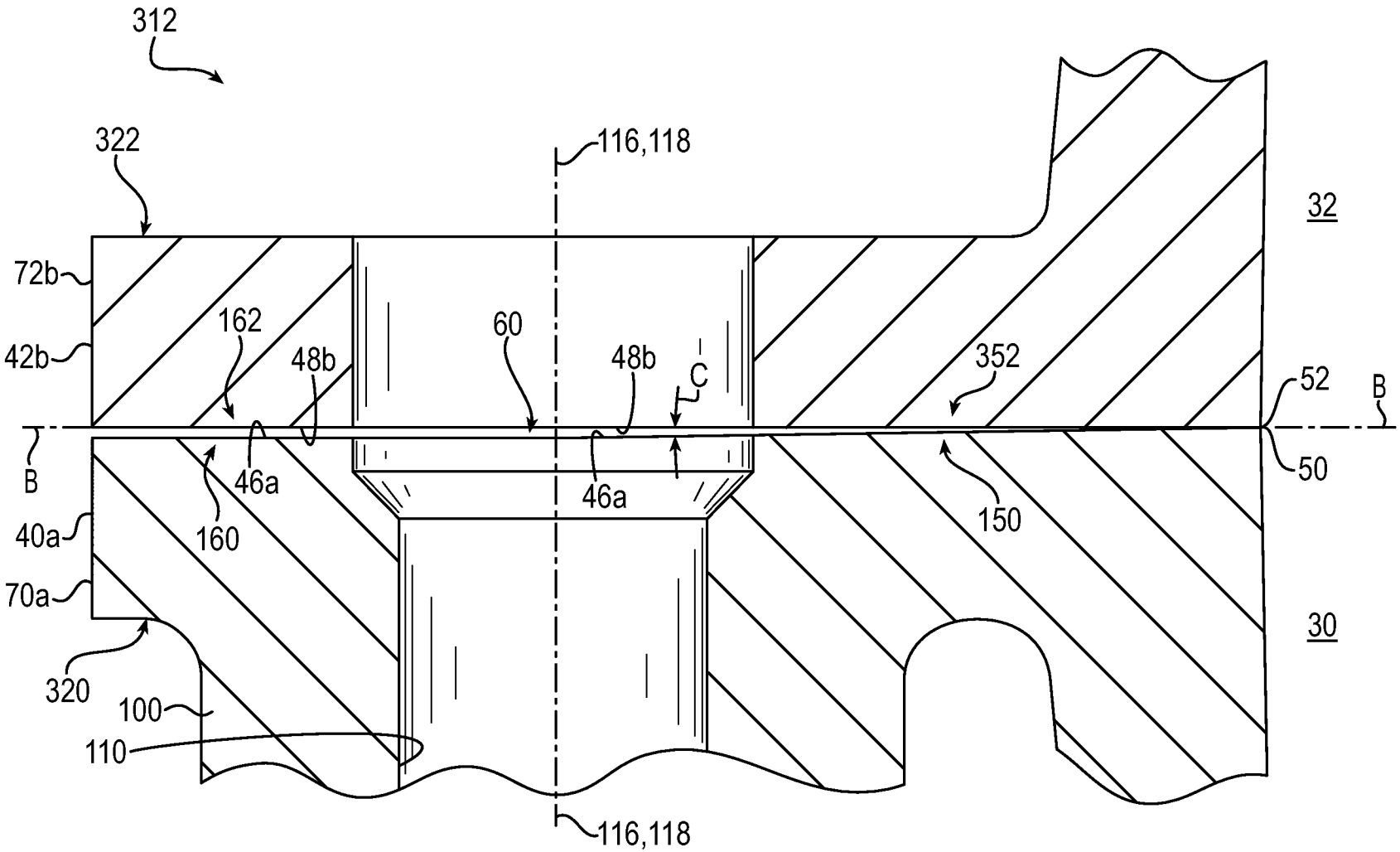
FIG. 8 is a cross-section view of a polarizer assembly in accordance with another embodiment of the invention.

The FIG. 8 polarizer assembly 312 has a first ramp 150 and three planar portions 160, 162, 352. The first flange face 46*a* thus forms a sloped gap while the second flange face 48*b* is planar. The nonuniform thickness gap 60 of the polarizer assembly 312 thus has a wedge shape gap formed by the sloped gap of the first ramp 150 and the planar portion 352, and a straight gap formed by the planar portions 160, 162, with the outer portion of the wedge shape gap having the same thickness, or height, as the inner portion of the straight gap, and the wedge shape gap thus transitioning into the straight gap. As with the FIG. 3A polarizer assembly 12, when the FIG. 8 polarizer assembly 312 is in an intermediate fastened state, the outer edge of the first flange face 46*a* contacts the second flange face 48*b* such that the nonuniform thickness gap 60 is formed between the channel edge contact regions 50, 52 and the outer edge contact of the first flange face 46*a* with the second flange face 48*b*. Similarly, when the FIG. 8 polarizer assembly 312 is in the fastened state, the first flange face 46*a* is engaged flush with the second flange face 48*b* to close the nonuniform thickness gap 60, in a manner similar to that shown in FIG. 6 of the FIG. 3A polarizer assembly 12.

Figure 9:
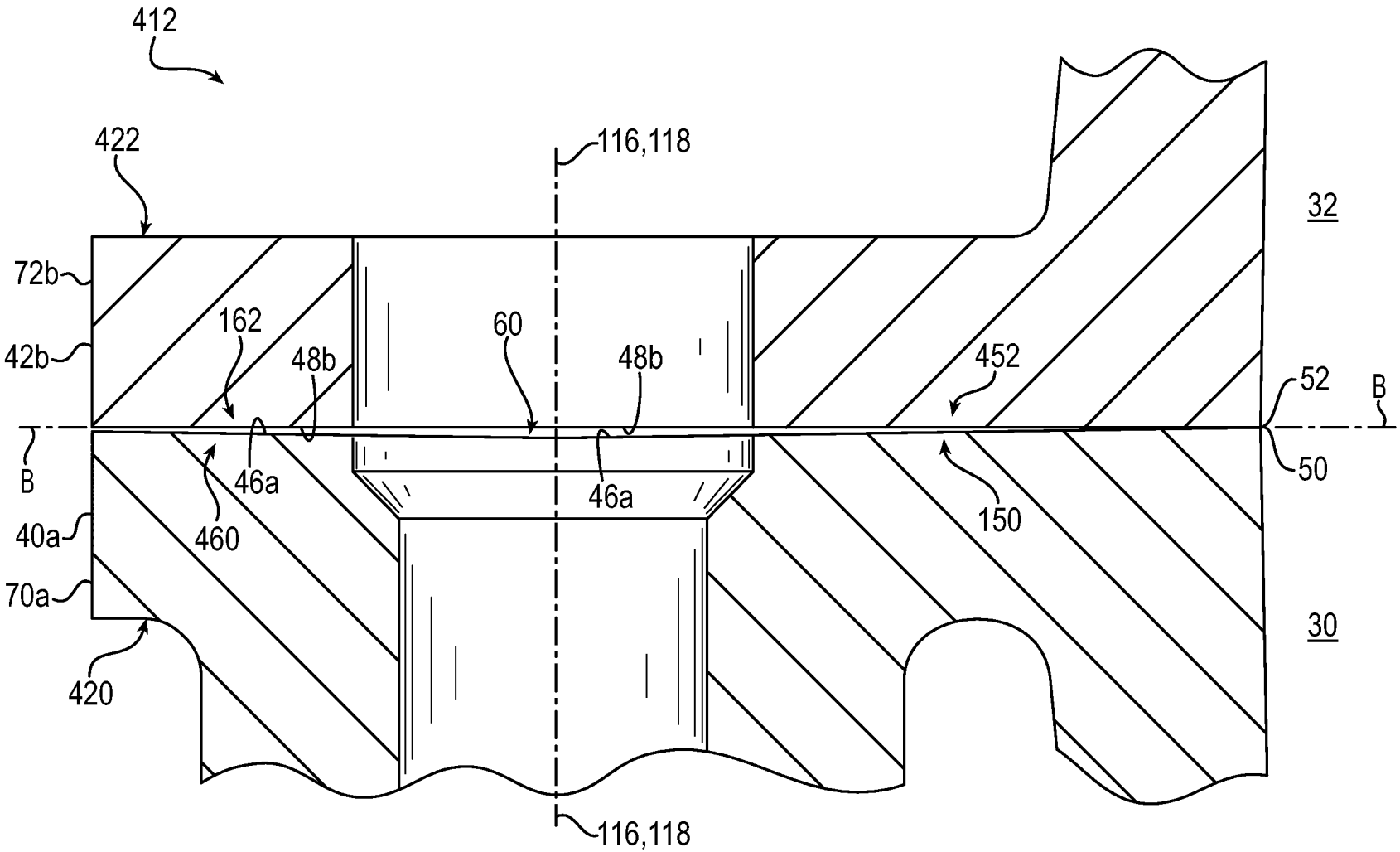
FIG. 9 is a cross-section view of a polarizer assembly in accordance with another embodiment of the invention.

The FIG. 9 polarizer assembly 412 has first and second components 420, 422, where the first component 420 has a first inner ramp 150 and a first outer ramp 460, and the second component 422 has a second inner planar portion 452 and a second outer planar portion 162. The first flange face 46*a* thus forms a sloped gap with the planar second flange face 48*b* at an inner region and outer region of the flanges 40*a*, 42*b*. The nonuniform thickness gap 60 of the polarizer assembly 412 thus has an inner wedge shape gap formed by the sloped gap of the first ramp 150 and the planar portion 452, and an outer wedge shape gap formed by the sloped gap of the second ramp 460 and the planar portion 162, with the wider portions of the inner and outer wedge shape gaps having the same thickness, or height, such that the inner wedge shape gap transitions into the outer wedge shape gap. As with the FIG. 3A polarizer assembly 12, when the FIG. 9 polarizer assembly 412 is in an intermediate fastened state, the outer edge of the first flange face 46*a* contacts the second flange face 48*b* such that the nonuniform thickness gap 60 is formed between the channel edge contact regions 50, 52 and the outer edge contact of the first flange face 46*a* with the second flange face 48*b*. Similarly, when the FIG. 9 polarizer assembly 412 is in the fastened state, the first flange face 46*a* is engaged flush with the second flange face 48*b* to close the nonuniform thickness gap 60, in a manner similar to that shown in FIG. 6 of the FIG. 3A polarizer assembly 12.

Figure 10:
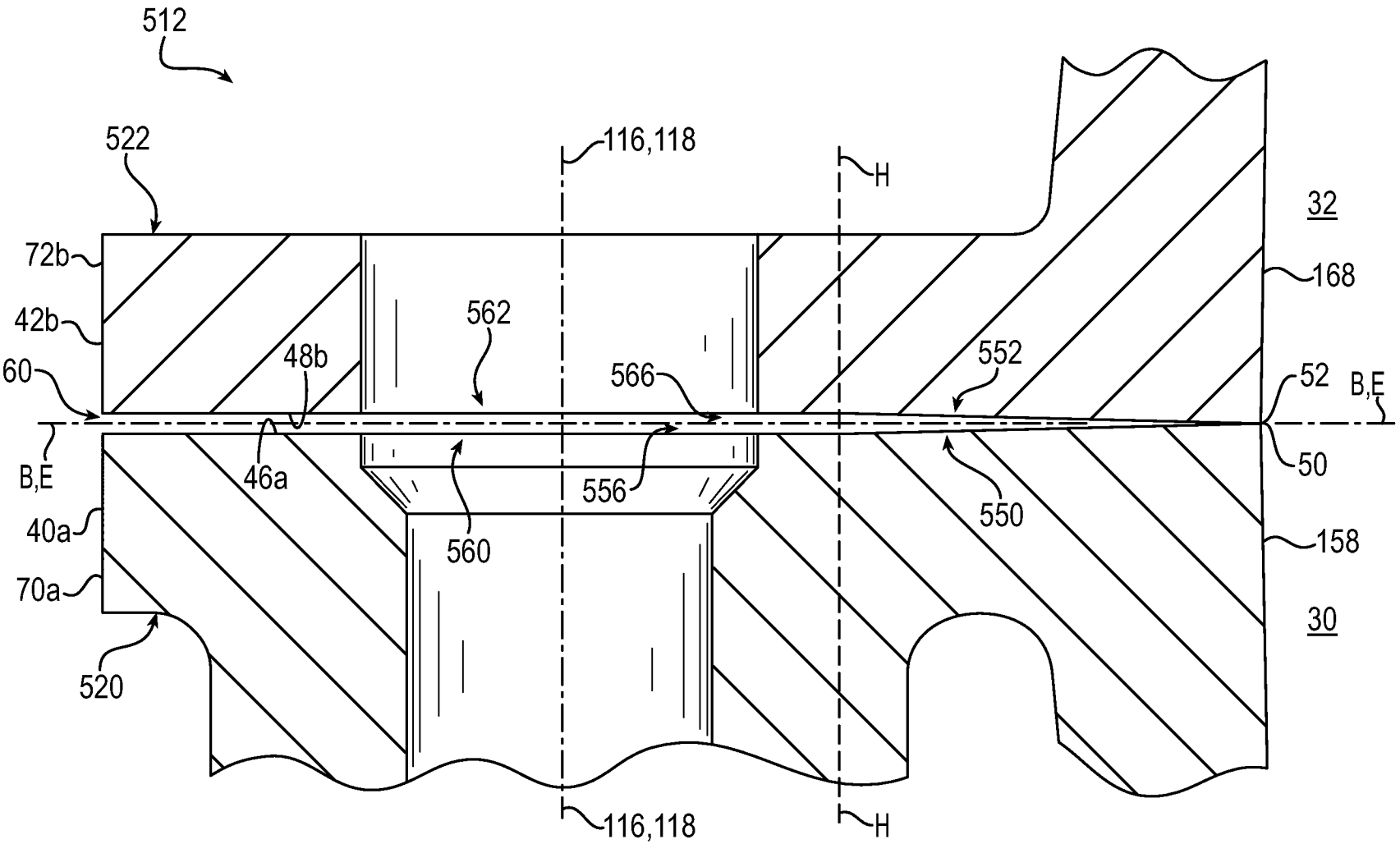
FIG. 10 is a cross-section view of a polarizer assembly in accordance with another embodiment of the invention.

Referring now to FIG. 10, the polarizer assembly 512 includes first and second components 520, 522, where the first component 520 has a first ramp 550 and a first planar portion 560, and the second component 522 has a second ramp 552 and a second planar portion 562. In the embodiment of FIG. 10, the first inner ramp 550 extends outwardly from the edge of the first channel portion 30 to a position H-H between the edge of the first channel portion 30 and the fastener centerline 116, 118. Further, the first ramp 550 extends to the first planar portion 560, which is parallel to the horizontal plane B-B that is perpendicular to the inside wall 158 at the edge of the first channel portion 30. The second flange 42*b* is configured in a manner similar to the first flange 40*a* in the FIG. 10 embodiment. Thus, the second ramp 552 extends outwardly from the edge of the second channel portion 32 to the position H-H between the edge of the second channel portion 30 and the fastener centerline 116, 118. In addition, the second ramp 552 extends to the planar portion 562, which is parallel to the horizontal plane E-E that is perpendicular to the inside wall 168 at the edge of the second channel portion 32. The nonuniform thickness gap 60 of the polarizer assembly 512 thus has a wedge shape gap formed by the sloped gaps 556, 566 of the first and second ramps 550, 552, and a straight gap formed by the planar portions 560, 562, with the outer portion of the wedge shape gap having the same thickness, or height, as the inner portion of the straight gap, and the wedge shape gap thus transitioning into the straight gap. As with the FIG. 3A polarizer assembly 12, when the FIG. 10 polarizer assembly 512 is in an intermediate fastened state, the outer edge of the first flange face 46*a* contacts the second flange face 48*b* such that the nonuniform thickness gap 60 is formed between the channel edge contact regions 50, 52 and the outer edge contact of the first flange face 46*a* with the second flange face 48*b*. Similarly, when the FIG. 10 polarizer assembly 512 is in the fastened state, the first flange face 46*a* is engaged flush with the second flange face 48*b* to close the nonuniform thickness gap 60, in a manner similar to that shown in FIG. 6 of the FIG. 3A polarizer assembly 12.

In the FIG. 10 embodiment, the transition from the first and second ramps 550, 552 to the first and second planar portions 560, 562 is at the position H-H located between the fastener centerline 116, 118 and the edges of the first and second channel portions 30, 32. It will be appreciated that the position of transition can be located anywhere between the edges of the first and second channel portions 30, 32 and the outer edges 70*a*, 72*b* of the first and second flanges 40*a*, 42*b*. For example, in an alternate configuration the first and second ramps 550, 552 can transition to the first and second planar portions 560, 562 at a position located between the fastener centerline 116, 118 and the outer edges 70*a*, 72*b* of the first and second flanges 40*a*, 42*b*. It will also be appreciated that the transition can be different for the flanges 40*a* and 42*b* of the respective components 20, 22. For example, the transition from the first ramp 550 to the first planar portion 560 can be at the position H-H located between the fastener centerline 116, 118 and the edges of the first and second channel portions 30, 32, while the transition from the second ramp 552 to the second planar portion 562 can be at a position other than the position H-H located between the fastener centerline 116, 118 and the edges of the first and second channel portions 30, 32, for example at a position located between the fastener centerline 116, 118 and the outer edges 70*a*, 72*b* of the first and second flanges 40*a*, 42*b*.

Figure 11:
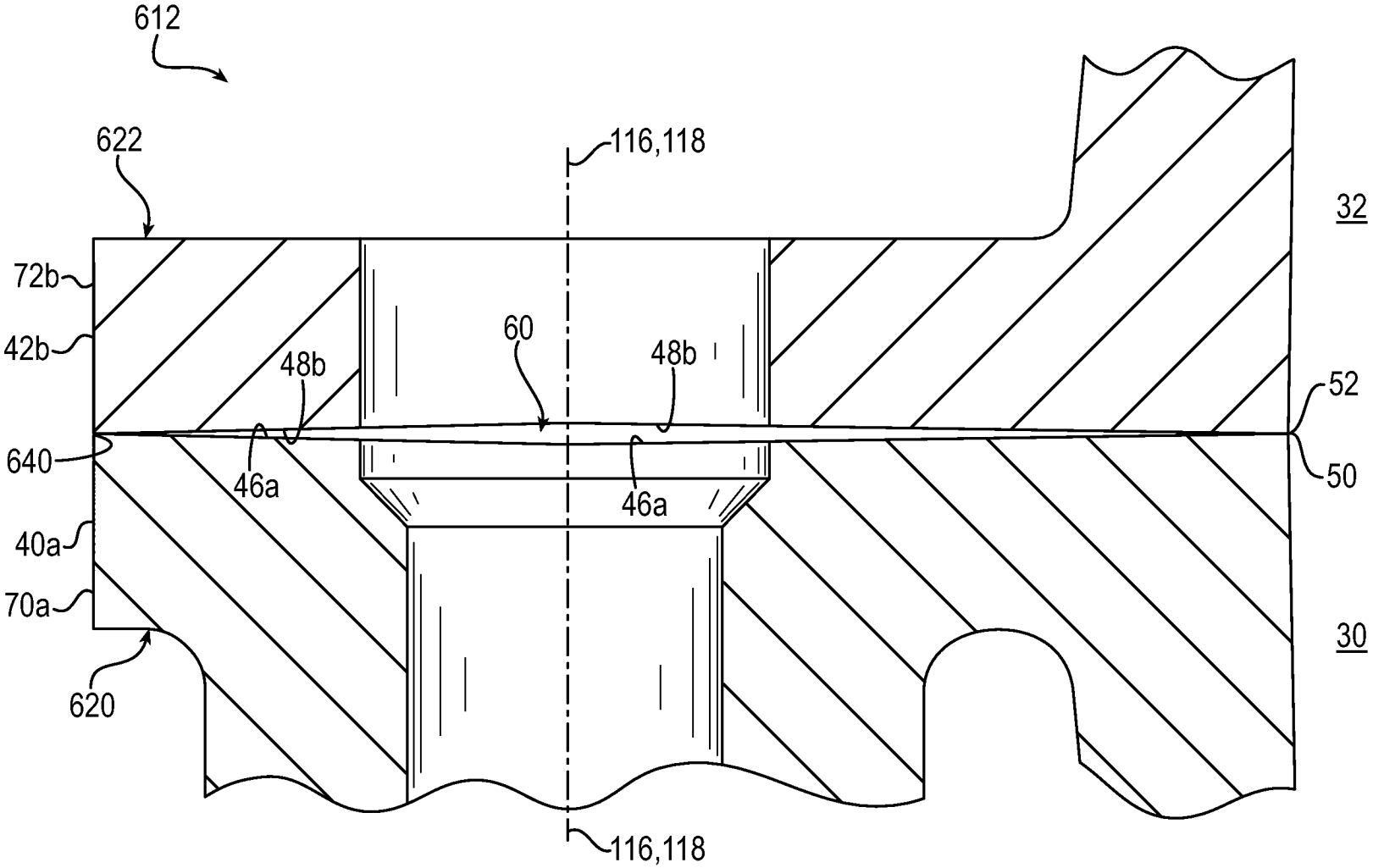
FIG. 11 is a cross-section view of a polarizer assembly in accordance with another embodiment of the invention.

FIG. 11 shows yet another embodiment of a polarizer assembly 612 according to the invention. The FIG. 11 polarizer assembly 612 is configured such that in the pre-fastened state (shown in FIG. 11) the outer edge 640 of the first flange face 46*a* contacts the second flange face 48*b* such that the nonuniform thickness gap 60 is formed between the inner and outer edge contacts of the first flange face 46*a* with the second flange face 48*b*. In the intermediate fastened state, then, the nonuniform gap 60 is narrowed relative to what is shown in FIG. 11. Further, when the FIG. 11 polarizer assembly 612 is in the fastened state, the first flange face 46*a* is engaged flush with the second flange face 48*b* to close the nonuniform thickness gap 60, in a manner similar to that shown in FIG. 6 of the FIG. 3A polarizer assembly 12.

In the above described embodiments of polarizer assemblies 12, 212, 312, 412, 512, 612, the angle of the ramps was described as about 1 degree. It will be appreciated that the angle of the ramps will be based on the material of the components 20, 22, and the amount of flex desired to be sustained by the flanges 40*a*, 40*b*, 42*a*, 42*b* to yield a tight seal bead at the edges of the first and second channel portions 30, 32 when the flanges are fastened together. In this regard, it has been found that the angle of the ramps may be between about 0.5 degrees and about 3.0 degrees.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A polarizer assembly, comprising:

a first component including a first channel portion and first flanges having first flange faces on opposite sides of the first channel portion; and a second component including a second channel portion and second flanges having second flange faces on opposite sides of the second channel portion;

wherein the first and second channel portions form a channel that for polarizing waveforms when the first and second components are in a fastened state;

wherein the first and second components are configured to flex between a pre-fastened state and the fastened state, wherein in the pre-fastened state the first flange face of at least one of the first flanges contacts an opposite facing second flange face of at least one of the second flanges at contact regions along respective edges of the first and second channel portions to form a nonuniform thickness gap between the first and second flange faces outwardly from the contact regions toward outer edges of the first and second components, and wherein in the fastened state the first flange face is engaged flush with the second flange face to close the nonuniform thickness gap.

2. The polarizer assembly of claim 1, wherein in an intermediate fastened state an outer edge of the first flange face contacts the second flange face such that the nonuniform thickness gap is formed between the channel edge contact regions and the outer edge contact of the first flange face with the second flange face.

3. The polarizer assembly of claim 1, wherein the at least one of the first flange faces has a first ramp that slopes away from the second flange face as the first ramp extends outwardly from the edge of the first channel portion toward the outer edge of the first component such that in the pre-fastened state an inner edge of the first flange face contacts the second flange face to form a sloped gap between the first and second flange faces outwardly from the inner edge of the first flange face, and in the fastened state the first ramp is engaged flush with the second flange face outwardly from the inner edge of the first flange face.

4. The polarizer assembly of claim 3, wherein in the pre-fastened state the angle of the slope of the first ramp is between about 0.5 degrees and about 3.0 degrees from a horizontal plane that is perpendicular to an inside wall at the edge of the first channel portion.

5. The polarizer assembly of claim 4, wherein in the pre-fastened state the angle of the slope of the first ramp is about 1 degree from the horizontal plane that is perpendicular to an inside wall at the edge of the first channel portion.

6. The polarizer assembly of claim 1, wherein the second flange face has a second ramp that slopes away from the first flange face as the second ramp extends outwardly from the edge of the second channel portion toward the outer edge of the second component such that in the pre-fastened state the sloping away of the second ramp contributes to the formation of the nonuniform thickness gap between the first and second flange faces.

7. The polarizer assembly of claim 6, wherein in the pre-fastened state the angle of the slope of a first ramp is substantially equal to the angle of the slope of the second ramp.

8. The polarizer assembly of claim 3, wherein the first flanges includes fasteners disposed along a fastener centerline spaced outwardly from the edge of the first channel portion and in the pre-fastened state the first ramp extends outwardly from the edge of the first channel portion to the fastener centerline.

9. The polarizer assembly of claim 3, wherein the first flanges includes fasteners disposed along a fastener centerline spaced outwardly from the edge of the first channel portion and in the pre-fastened state the first ramp extends outwardly from the edge of the first channel portion to a position between the edge of the first channel portion and the fastener centerline.

10. The polarizer assembly of claim 3, wherein in the pre-fastened state the first ramp extends outwardly from the edge of the first channel portion to a planar portion that lies in a horizontal plane that is perpendicular to an inside wall at the edge of the first channel portion.

11. The polarizer assembly of claim 3, wherein in the pre-fastened state the first ramp extends outwardly from the edge of the first channel portion to an outer ramp that slopes toward the second flange face as the outer ramp extends outwardly from an outer edge of the first ramp toward the outer edge of the first component.

12. The polarizer assembly of claim 11, wherein in the pre-fastened state the outer edge of the first flange face contacts the second flange face such that the nonuniform thickness gap is formed between the inner and outer edge contacts of the first flange face with the second flange face.

13. The polarizer assembly of claim 11, wherein in the pre-fastened state the angle of the slope of the outer ramp is between about 0.5 degrees and about 3.0 degrees from a horizontal plane that is perpendicular to an inside wall at the edge of the first channel portion.

14. The polarizer assembly of claim 1, wherein the first and second components have the same geometry.

15. A polarizer assembly, comprising:

a first component including a first channel portion and first flanges on opposite sides of the first channel portion; and a second component including a second channel portion and second flanges on opposite sides of the second channel portion;

wherein the first and second channel portions form a channel for polarizing waveforms when the first and second components are in a fastened state;

wherein the first and second flanges have respective first and second flange faces that face each other;

wherein at least one of the first flange faces has a first ramp that slopes away from the second flange face over at least a portion of the distance between an edge of the first channel portion and an outer edge of the first component such that in a pre-fastened state an initial contact edge of the first flange face contacts the second flange face to form a nonuniform gap between the first and second flange faces outwardly from the initial contact edge;

wherein the first and second components are configured to flex between the pre-fastened state and the fastened state such that in the fastened state the ramp of the first flange face engages flush with the second flange face outwardly from the initial contact edge of the first flange face.

16. The polarizer assembly of claim 15, wherein the first ramp slopes away from the second flange face outwardly from the edge of the first channel portion toward an outer edge of the first component.

17. The polarizer assembly of claim 15, wherein the initial contact edge is an inside edge of the first flange face.

18. The polarizer assembly of claim 15, wherein in the pre-fastened state the initial contact edge of the first flange face contacts the second flange face at the edge of the first channel portion, and in the fastened state the ramp of the first flange face engages flush with the second flange face outwardly from the edge of the first channel portion.

19. The polarizer assembly of claim 15, wherein in the pre-fastened state the angle of the slope of the first ramp is between about 0.5 degrees and about 3.0 degrees from a horizontal plane that is perpendicular to an inside wall at the edge of the first channel portion.

20. The polarizer assembly of claim 19, wherein in the pre-fastened state the angle of the slope of the first ramp is about 1 degree from the horizontal plane that is perpendicular to an inside wall at the edge of the first channel portion.

* * * * *